US011898341B2

(12) United States Patent
Olund

(10) Patent No.: US 11,898,341 B2
(45) Date of Patent: Feb. 13, 2024

(54) BUILDING CORE AND KIT FOR ASSEMBLY

(71) Applicant: Greencore Structures Ltd., North Vancouver (CA)

(72) Inventor: Brent G. Olund, North Vancouver (CA)

( * ) Notice: Subject to any disclaimer, the term of this patent is extended or adjusted under 35 U.S.C. 154(b) by 35 days.

(21) Appl. No.: 17/888,760

(22) Filed: Aug. 16, 2022

(65) Prior Publication Data

US 2023/0046029 A1 Feb. 16, 2023

Related U.S. Application Data

(60) Provisional application No. 63/233,342, filed on Aug. 16, 2021.

(51) Int. Cl.

| | |
|---|---|
| ***E04B 1/24*** | (2006.01) |
| ***E04C 3/32*** | (2006.01) |
| ***E04B 1/84*** | (2006.01) |
| ***E04B 1/38*** | (2006.01) |

(52) U.S. Cl.

CPC ..... *E04B 1/2403* (2013.01); *E04B 1/388* (2023.08); *E04B 1/84* (2013.01); *E04C 3/32* (2013.01); *E04B 2001/246* (2013.01); *E04B 2001/2421* (2013.01); *E04B 2001/2469* (2013.01); *E04B 2001/2481* (2013.01)

(58) Field of Classification Search

CPC ..... E04B 1/2403; E04B 1/388; E04B 1/84; E04B 2001/2421; E04B 2001/246; E04B 2001/2469; E04B 2001/2481; E04B 2001/2451; E04C 3/32; E04C 3/36

See application file for complete search history.

(56) References Cited

U.S. PATENT DOCUMENTS

| | | | |
|---|---|---|---|
| 7,219,474 | B2 | 5/2007 | Lawson et al. |
| 7,559,175 | B2 | 7/2009 | Da Costa Lima |
| 7,900,410 | B2 | 3/2011 | Skendzic et al. |
| 8,033,062 | B2 | 10/2011 | Ferriere |

(Continued)

FOREIGN PATENT DOCUMENTS

| | | | |
|---|---|---|---|
| CN | 106869369 | A | 6/2017 |
| EP | 0955422 | A1 | 11/1999 |

(Continued)

OTHER PUBLICATIONS

Binck, C., "Lateral Stiffening Systems for Tall Timber Buildings—Tube-in-tube Systems," Wood Material Science & Engineering, 2022, vol. 17(4), pp. 309-316, Retrieved from the Internet: URL: https://doi.org/10.1080/17480272.2022.2086066.

(Continued)

*Primary Examiner* — Rodney Mintz

(74) *Attorney, Agent, or Firm* — Thomas M. Joseph, Esq.

(57) ABSTRACT

A column assembly has an elongated tubular member. A wall end assembly has an elongated tubular member. A flexible interface connects the column assembly to the wall end assembly. The flexible interface includes a spring pack assembly having a disc spring, an elongated male fastening member, a female fastening member, and an absorbing layer. The male fastening member extends through the spring pack hole into the female fastening member to connect the column assembly to the wall end assembly with the female fastening member and to hold the male fastening member in place.

20 Claims, 8 Drawing Sheets

(56) References Cited

U.S. PATENT DOCUMENTS

| | | | | |
|---|---|---|---|---|
| 8,065,846 | B2 | 11/2011 | McDonald et al. | |
| 8,297,023 | B2 | 10/2012 | Collins | |
| 8,365,473 | B2 | 2/2013 | Bjerre | |
| 8,739,475 | B2 | 6/2014 | Michaud et al. | |
| 9,567,741 | B2 * | 2/2017 | Espinosa | E04B 5/40 |
| 10,753,080 | B1 * | 8/2020 | Houston | E04B 1/3516 |
| 11,274,432 | B2 * | 3/2022 | Houston | E04G 21/167 |
| 11,608,626 | B2 * | 3/2023 | Kim | E04B 1/2403 |
| 2015/0184373 | A1 * | 7/2015 | Espinosa | E04B 1/4164 52/701 |
| 2015/0308096 | A1 | 10/2015 | Merhi et al. | |
| 2018/0245340 | A1 | 8/2018 | Viskovic et al. | |
| 2019/0177975 | A1 | 6/2019 | Moskovitch | |
| 2020/0385981 | A1 * | 12/2020 | Houston | E04B 1/3404 |
| 2021/0131100 | A1 | 5/2021 | Lim | |
| 2023/0041026 | A1 * | 2/2023 | Kim | E04B 1/5831 |

FOREIGN PATENT DOCUMENTS

| | | | |
|---|---|---|---|
| EP | 1579086 | B1 | 8/2007 |
| JP | 5398933 | B1 | 1/2014 |
| WO | 2007080561 | A1 | 7/2007 |

OTHER PUBLICATIONS

Cui, Y., et al., "Self-Centering Steel-Timber Hybrid Shear Wall: Experimental Test and Parametric Analysis," Materials, 2020, vol. 13(11), pp. 2518.

Gasparri, E., et al., Unitised Timber Envelopes. A Novel Approach to the Design of Prefabricated Mass Timber Envelopes for Multi-storey Buildings, Journal of Building Engineering, 2019, vol. 26, pp. 1-37, Retrieved from the Internet: URL: https://doi.org/10.1016/j.jobe.2019.100898.

Hashemi, A., et al., "Seismic Resilient Mass Timber Structures With Damage-avoidance Connections: Design Methods and Case Studies," SOC Conference 2021, 2021, pp. 1-15, Retrieved from the Internet: URL: https://2021conf.sesoc.org.nz/PDFs/S5A%20P2%20-%20Hashemi_Fast_Dickof_Jackson_Fast_Dunbar_Zarnani_Quenneville.pdf.

Huber, J.A.J., et al., Structural Robustness and Timber Buildings—a Review, Wood Material Science & Engineering, 2019, vol. 14(2), pp. 107-128, Retrieved from the Internet: URL: https://doi.org/10.1080/17480272.2018.1446052.

Zhang, X., et al., "High-capacity Hold-down for Mass-timber Buildings," Construction and Building Materials, Mar. 2018, vol. 164, pp. 688-703, Retrieved from the Internet: URL: https://doi.org/10.1016/j.conbuildmat.2018.01.019.

* cited by examiner

BUILDING CORE AND KIT FOR ASSEMBLY

CROSS REFERENCE TO RELATED APPLICATION

This application claims the benefit under 35 U.S.C. § 119(e) of U.S. Provisional Application No. 63/233,342 entitled "BUILDING CORE AND KIT FOR ASSEMBLY" filed Aug. 16, 2021, which is incorporated herein by reference.

BACKGROUND

Various approaches to the construction of high-rise buildings and similar structures have been suggested over the last fifty years. In the 1960s, tall buildings were braced around their perimeters, but developers and tenants objected to obstructed views. As a result, building designs tended to shift toward steel cores.

Conventional steel cores have proven to be uneconomical, so that they were replaced, in the 1980s, by structural systems with braces of large composite columns filled with concrete. Such structural systems utilized columns that could obstruct or limit the placement of elevators, bathrooms, and corridors. Consequently, such buildings were built with reinforced concrete cores, starting in the 1990s and continuing today.

Reinforced concrete cores have several disadvantages. For example, the amount of time to build such buildings is greatly affected by the amount of time that it takes to pour the concrete cores. Further, a substantial amount of work must be performed at the building site, which can further lengthen building timelines. Additionally, certain mechanical properties of the reinforced concrete cores are undesirable. Finally, the building process is unnecessarily complicated with, inter alfa, acceptable dimensional tolerances being very difficult to achieve, which further drives up costs. In the current awareness of climate change and how the embodied carbon of building materials contributes to that, a need exists for lower embodied carbon structural systems for various structural applications. Accordingly, there is currently a need for an improved system for assembling buildings and building cores.

SUMMARY

The following summary is provided to introduce a selection of concepts in a simplified form that are further described below in the detailed description. This summary is not intended to identify key features or essential features of the claimed subject matter, nor is it intended to be used to limit the scope of the claimed subject matter.

In various implementations, a building core includes a column assembly having an elongated tubular member. A wall end assembly has an elongated tubular member. A flexible interface connects the column assembly to the wall end assembly. The flexible interface includes a spring pack assembly having a disc spring, an elongated male fastening member, a female fastening member, and an absorbing layer. The male fastening member extends through the spring pack hole into the female fastening member to connect the column assembly to the wall end assembly with the female fastening member and to hold the male fastening member in place.

In other implementations, a kit for assembling a building core is provided. A column assembly has an elongated tubular member. A wall end assembly has an elongated tubular member. A flexible interface can connect the column assembly to the wall end assembly. The flexible interface includes a spring pack assembly having a disc spring, an elongated male fastening member, a female fastening member, and an absorbing layer. The male fastening member can extend through the spring pack hole into the female fastening member to connect the column assembly to the wall end assembly with the female fastening member and to hold the male fastening member in place when the building core is assembled. This mode of connection is provisioned to be able to occur on any of the faces of the column assembly.

These and other features and advantages will be apparent from a reading of the following detailed description and a review of the appended drawings. It is to be understood that the foregoing summary, the following detailed description and the appended drawings are explanatory only and are not restrictive of various aspects as claimed.

DETAILED DESCRIPTION

Figure 1:
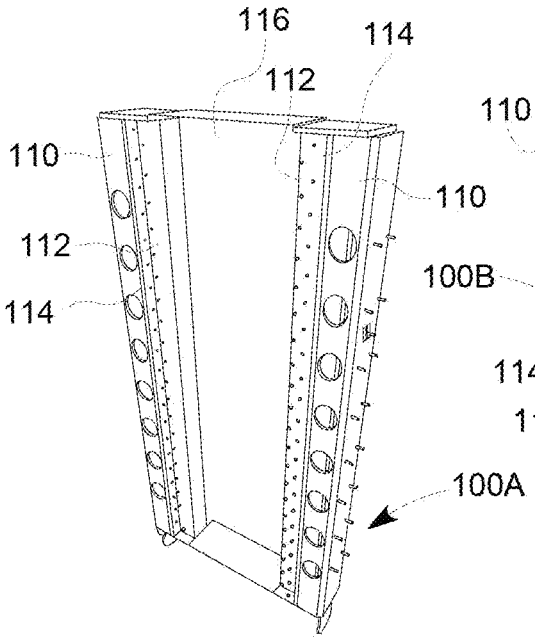
FIG. 1 is a perspective view of an exemplary building core in accordance with the subject disclosure.
Figure 2:
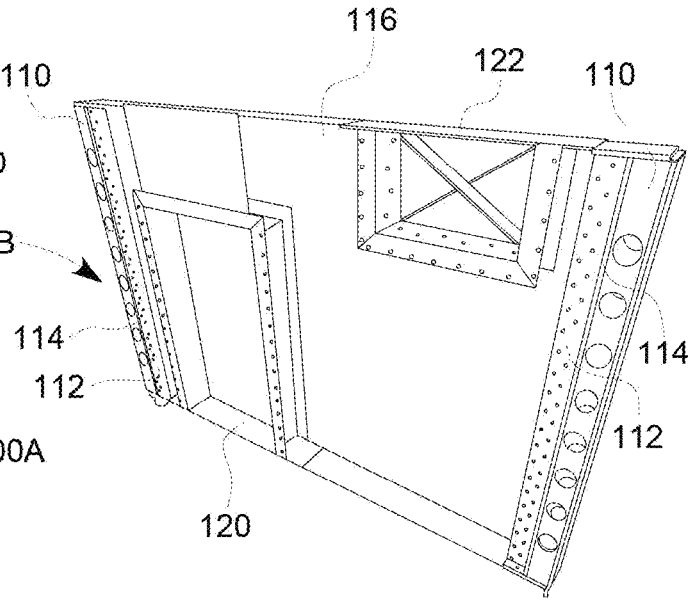
FIG. 2 is a perspective view of another exemplary building core in accordance with the subject disclosure.
Figure 3:
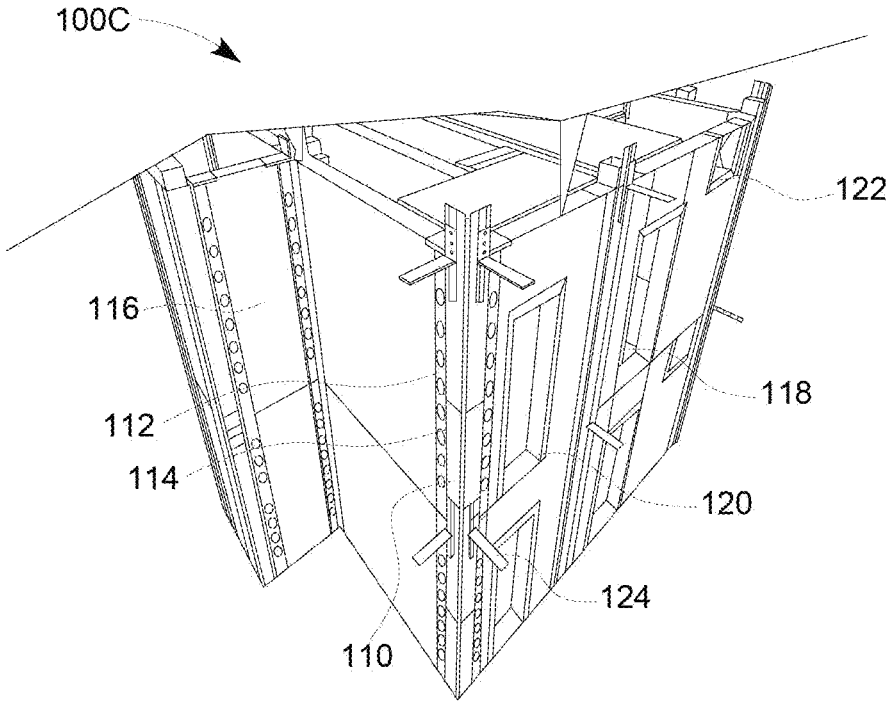
FIG. 3 is a perspective view of another exemplary building core in accordance with the subject disclosure.

The subject disclosure is directed to improved building cores and kits for assembling such building cores and, more specifically, to building cores that can be rapidly assembled from a column assembly, a wall end assembly, and a flexible interface connecting the column assembly to the wall end assembly. The building cores include steel fastening kits and panelized members formed from mass timber materials.

The detailed description provided below in connection with the appended drawings is intended as a description of examples and is not intended to represent the only forms in which the present examples can be constructed or utilized. The description sets forth functions of the examples and sequences of steps for constructing and operating the examples. However, the same or equivalent functions and sequences can be accomplished by different examples.

References to "one embodiment," "an embodiment," "an example embodiment," "one implementation," "an implementation," "one example," "an example" and the like, indicate that the described embodiment, implementation or example can include a particular feature, structure or characteristic, but every embodiment, implementation or example can not necessarily include the particular feature, structure or characteristic. Moreover, such phrases are not necessarily referring to the same embodiment, implementation or example. Further, when a particular feature, structure or characteristic is described in connection with an embodiment, implementation or example, it is to be appreciated that such feature, structure or characteristic can be implemented in connection with other embodiments, implementations or examples whether or not explicitly described.

Numerous specific details are set forth in order to provide a thorough understanding of one or more embodiments of the described subject matter. It is to be appreciated, however, that such embodiments can be practiced without these specific details.

Various features of the subject disclosure are now described in more detail with reference to the drawings, wherein like numerals generally refer to like or corresponding elements throughout. The drawings and detailed description are not intended to limit the claimed subject matter to the particular form described. Rather, the intention is to cover all modifications, equivalents and alternatives falling within the spirit and scope of the claimed subject matter.

The subject disclosure is directed to a kit of metal connectors that are designed to enable the prefabrication of panelized wooden building cores in such structures as point towers. The building cores are structures that, when assembled, include less embodied carbon than conventional buildings that are formed with steel and/or concrete cores. The assembly of the cores provides for buildings that can be assembled faster and provide higher economical value than conventional structures.

The use of the subject kits to assemble the core structures can reduce construction time and embodied carbon for buildings and, in particular, for buildings in the height range of eight to eighteen stories. The disclosed systems enable the assembly of building cores that can include elevators and stairs and that can be assembled concurrently with the assembly of the structure.

The subject disclosure includes a core system that utilizes connector columns that create a strong node for moment connections in all three axes. These connections can be made in orthogonal directions to incoming structural wall segments. The connector columns are used with wall end assemblies that provide means for fastening to structural wall segments and to connector columns.

Fastening components can be used in interfaces that provides the building core with the ability to deflect and to re-center. Through the use of these interfaces, the building core can dampen and absorb seismic energy in a manner that is resilient and does not involve permanent damage or deformation of the core components.

The subject building cores can be assembled through a designated erection sequence in which wall panels can be connected to one another in a manner that minimizes or eliminates the use of bracing during the sequence. The prefabricated wall panels are readily liftable by typical industry tower cranes.

The core building components are designed to enable a three-stage "plumbing up" of core panels between the typical tolerances that are involved in initial crane hoisting and setting. The disclosed subject matter is suitable for precision movement tolerances that are required in the alignment for final assembly and/or connection.

The core building components include female fastening members that receive male fastening members that project through wall-end assemblies. In some embodiments, the male fastening member is a bolt. The female fastening member is a nyloc nut, which provides the ability to connect components without torqueing the bolted connection and to secure the component without having it become loose. As a result, a spring pack assembly is not compressed, for the most part, during the installation of the system, which provides the ability for the spring to deflect, elastically, and to re-center the building.

A connector column can pull on a bolt from a wall-end assembly in the following sequence. First, the Belleville washers, which can be used in pairs concentrically beneath a two-leaf rectangular spring, can compress before bottoming out onto a load-spreading plate. Second, the load-spreading plate compresses an absorbing layer. Third, if the system extends or moves beyond a threshold permanent damage can occur in the connection between the wall-end assembly and a wooden panel. Initially, the damage occurs by bending of a plurality of stainless steel tight-fit pins. Later, later by tearing of the wooden panel material itself, which can, eventually, lead to structural failure.

The system is designed in a manner in which the first three steps of the sequence occurs and the fourth step does not occur. As a result, a catastrophic failure will not occur.

Referring to the drawings and, in particular, to FIGS. 1-5, there is shown various examples of building core structures, generally designated by the numerals 100A-100E. Each of the building core structures 100A-100E includes one or more column assemblies 110, one or more wall end assemblies 112, and interfaces 114 to connect the column assemblies 110 to the wall end assemblies 112.

The column assemblies 110 are configured to provide for rapid building erection through socket connections to one another at different floor levels. Each of the interfaces 114 utilizes springs, a bearing or load spreading plate, and a structural acoustical strip material. In this exemplary embodiment, the column assemblies 110, the wall end assemblies 112, and interfaces 114 are constructed from metal and, in particular, steel. The column assemblies 110, the wall end assemblies 112, and interfaces 114 are constructed from metal and, in particular, steel.

The building core structures 100A-100E can include, additionally, wall panels 116, floor panels or slabs 118, door frames 120, and mechanical shaft opening frames 122. The wall end assemblies 112 can connect to the wall panels 116 to transmit high shear working loads along the entirety of the height of each the wall panels 116. In this exemplary embodiment, the wall panels 116 and the floor panels or slabs 118 are constructed from wood or timber. The door frames 120 and the window frames 122 can be constructed from metal, wood, and/or timber. The door frames 120 and the window frames 122 can be reinforcing frames. In some embodiments, field welding can be used to connect seams of the door frames 120, when they are stacked on top of one another in one of the assembled building core structures 100A-100E. In contrast, the wall end assembly 212 does not require welding.

The building slabs surrounding the building core can be laterally held around the core by shear collectors or drag strap connectors 124 that extend outward from the building core onto the surrounding slabs from the column assemblies 110 in a level plane and in a substantially perpendicular direction relative to a vertically aligned column assembly 110. The drag strap connectors 124 are adjustable height structural connections.

Connector columns can be connected to one another via welding or other similar joining methods. In such embodiments, field welding can be used, so that only field welds contact the connector columns. Further, field welding can be used across the horizontal edge of a vertical plate.

Figure 4:
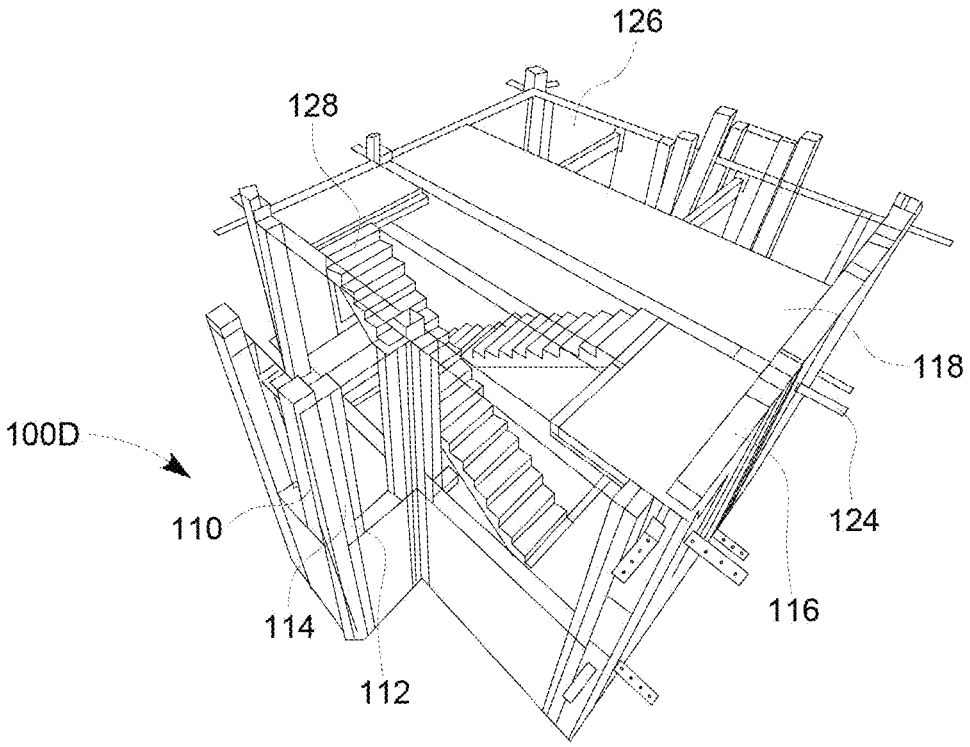
FIG. 4 is a perspective view of another exemplary building core that includes a scissor stair in accordance with the subject disclosure.
Figure 5:
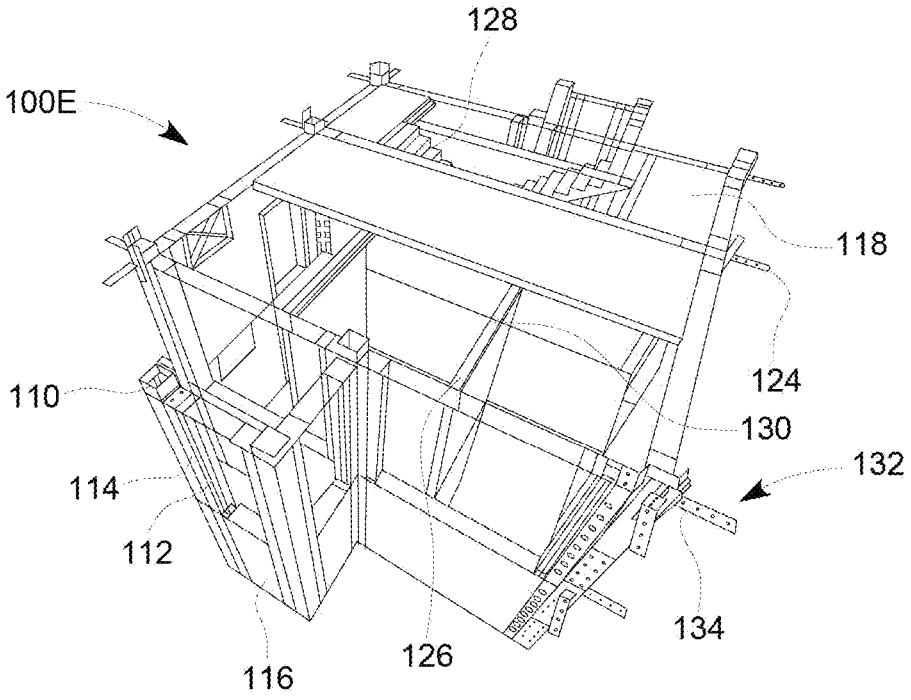
FIG. 5 is a perspective view of another exemplary building core that includes building shafts in accordance with the subject disclosure.
Figure 6:
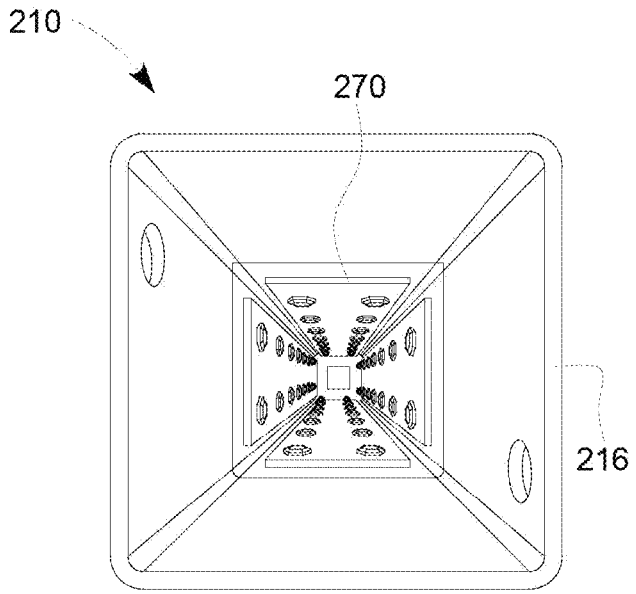
FIG. 6 is a top view of a column assembly in accordance with the subject disclosure.

As shown in FIGS. 4-5, the building core structures 100D-100E can include building shafts 126 and staircases 128. The building shafts 126 can be suitable for use as elevator shafts. The building shafts 126 can be mechanical shaft openings. In some embodiments, the building shafts 126 can include freight elevator shafts, passenger elevator shafts, mechanical and/or electrical services shafts, and elevator lobbies. The staircases 128 can include a scissor stair of landing and stair dimensions, stairs rise and run, and exit door clearances, which can meet Building Codes in the United States and Canada.

Elevator divider beams 130 can be strengthened and extended to support an elevator lobby slab (not shown), which can be constructed from mass timber material. In some embodiments, some ledger angles on adjacent vertical wall segments can be used to further support that slab. Alternatively, such ledger angles can support stairway landing slabs, as well as a single outer sloping lateral edge of each flight of stairs.

As shown in FIG. 5, the building core structure 100E can include a drag strut anchorage assembly 132 includes a vertical plate 134. The drag strut anchorage assembly 132 can include a Halfen Channel that can be used in conjunction with Halfen T-bolts to enable different attachment elevations for drag strut. The vertical plate 134 can include a lower part that can fasten to another column (not shown) that can be below using fasteners. In this exemplary embodiment, the fasteners include eight bolts.

An upper edge of the plate 134 can fastens to an upper column with a field weld. In this exemplary embodiment, the connection can have a vertical tolerance that accommodates the usage of ring-shaped shims of varying thickness within column-to-column interfaces.

Referring now to FIGS. 6-13 with continuing reference to the foregoing figures, a core unit, generally designated by the numeral 200, is shown. The core unit 200 is formed from a column assembly 210, a wall end assembly 212, and an interface 214 that connects the column assembly 210 to the wall end assembly 212.

The column assembly 210 includes an elongated tubular member 216. The wall end assembly 212 includes an elongated tubular member 218. The interface 214 includes a spring pack assembly 220 having pairs of disc springs 222-224, an elongated male fastening member 226, a female fastening member 228, and, optionally, spring packs 230-232 (i.e two-leaf springs) having a hole 234 extending therethrough. The interface 214 also includes an absorbing layer 236.

In some embodiments, the disc springs 222-224 can be positioned between the spring packs 230-232 and a load-spreading plate 242 and are assembled in a stack. In such embodiments, the male fastening member 226 extends through the spring pack 234 hole into the female fastening member 228 to connect the column assembly 210 to the wall end assembly 212 with the female fastening member 226 and to hold the male fastening member 226 in place. However, in such embodiments, the spring packs 230-232 can be eliminated.

It should be understood that the elongated tubular member 216 can be supported by shims of varying thickness. The shims can be configured in the shape of the outer cross section of the lower portion of the elongated tubular member 216.

Further, while the depicted elongated tubular member 216 includes four plug weld slots per face, other exemplary embodiments can include a different number of plug weld slots, such as two.

Figure 13:
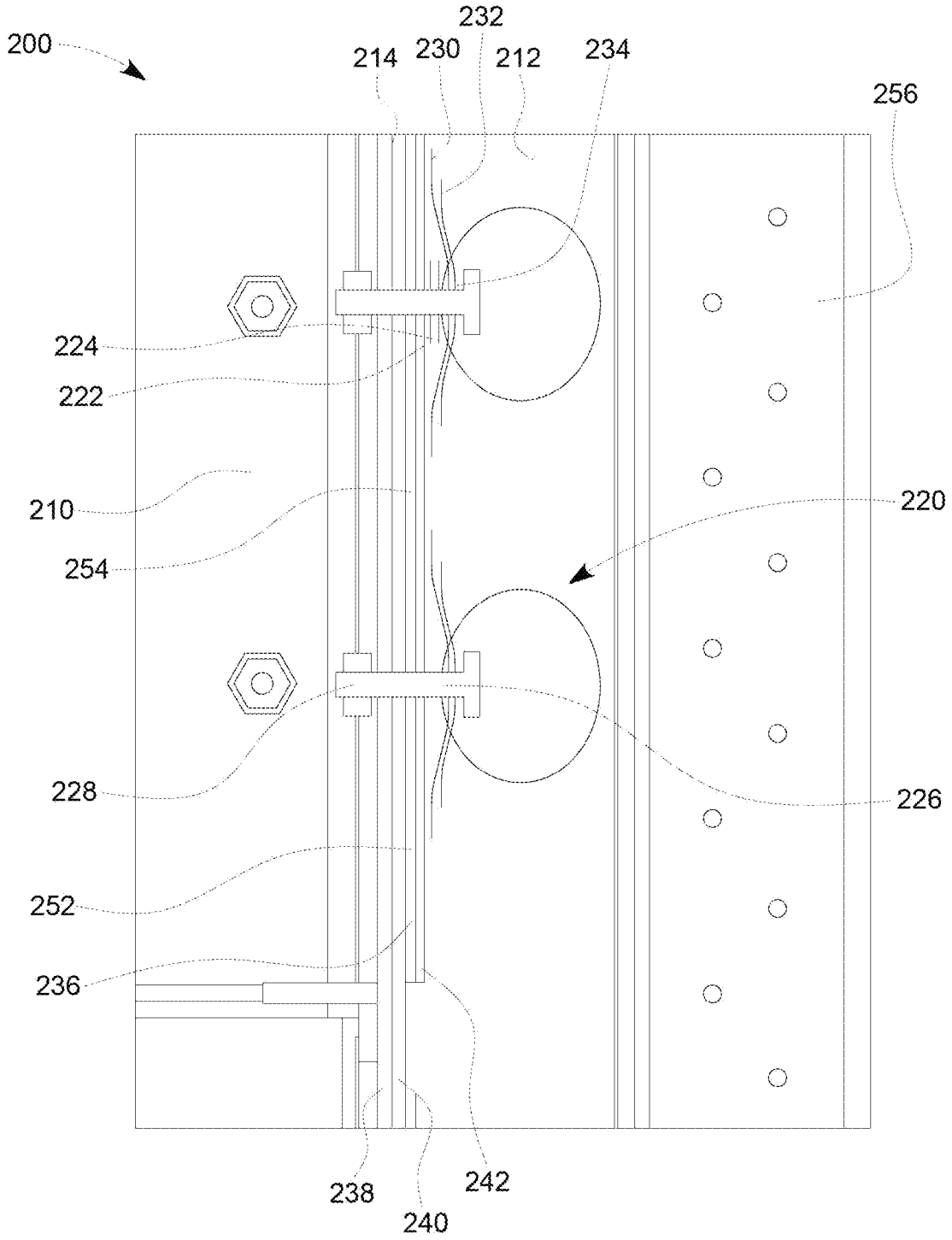
FIG. 13 is a fragmentary cross section in side elevation of the exemplary building core shown in FIG. 10.

As shown in FIG. 13, the disc springs 222-224 distribute an applied load throughout the interface 214. The disc springs 222-224 are eventually compressed under more substantial seismic loads and movements, which results in the male fastening member 226 being held in increased tension. In some embodiments that include the spring packs 230-232, the compressed disc springs 222-224 will have three points of contact on the load spreading plate 242. Other embodiments achieve one point of contact.

The third point of contact under the double pairs of disc springs 222-224 will only occur under relatively extreme loads, which helps to further spread out the loading along the load spreading plate 242 and assist structural acoustical strip material 236 to viscoelastically absorb additional movement in the system without itself being crushed.

Additionally, the column assembly 210 can include a chassis 238. The wall end assembly 212 can include a chassis 240. The interface 214 includes the load-spreading plate 242. The chassis 238 can be formed from steel hollow structural sections. Further, the column assembly 210 can include an inner plate that holds a pattern of sixteen nyloc nuts in a predetermined patter or grid relative to each other.

As shown in FIGS. 10-13, the interface 214 facilitates a connection between the column assembly 210 and the wall end assembly 212 that allows the wall end assembly 212 to move slightly relative to the column assembly 210 in a viscoelastic fashion which dissipates some seismic energy, during a seismic event, while resulting in the re-centering of each wall segment that is connected to the core unit 200. The subject bolted connection provides the resulting structure that is formed with the core unit 200 with elasticity and ductility.

Referring now to FIGS. 6-13, the core unit 200 can be configured to facilitate connections between the column assembly 210 and other column assemblies (not shown) in a stackable manner. In order to facilitate stacking, the wall end assembly 212 can include a slot 244 on one end plate 246 and a tab 248 on the opposite end plate 250.

The tab 248 can insert into a slot (not shown) in another, substantially identical core unit (not shown) and/or into a base or foundation (not shown) that supports the core unit 200. The connections that result therefrom can be further facilitated by forming joints through conventional joining processes, such as bolting. In this exemplary embodiment, the tab 248 is teardrop-shaped and the slot 244 is designed to accommodate the teardrop-shape.

The end plate 246 can be a thick plate that confines mass timber members when shear forces are applied thereto. Through this configuration, the end plate 246 contributes additional connection rigidity beyond the rigidity that is provided through tight-fit pins that are inserted into the mass timber material.

The male fastening member 226 and the female fastening member 228 can be any suitable fastening system components. In this exemplary embodiment, the male fastening member 226 and the female fastening member 228 comprise a male and female fastening system, specifically a bolt and a nut. In some embodiments, the nut is a nyloc nut.

The disc springs 222-224 can be washer-shaped springs or other similar resilient devices that can be loaded along its axis either statically or dynamically. The disc springs 222-224 can have essentially conical and/or frusto-conical shapes and can be Belleville washers, coned-disc springs, conical spring washers, disc springs, Belleville springs or cupped spring washers. Typically, they are used in pairs in order to function as axial springs.

The absorbing layer 236 can include a plate 252 and absorbing materials 254. The absorbing materials 254 can be acoustical absorbing materials, acoustical pad materials and/or a high-performance resilient profile material. Suitable materials include plastics, such as vinyl, rubber, and/or XYLOFON. XYLOFON is a trademark of Rotho Blaas SRL of Cortaccia sulla strada del vino BZ, Italy.

Figure 8:
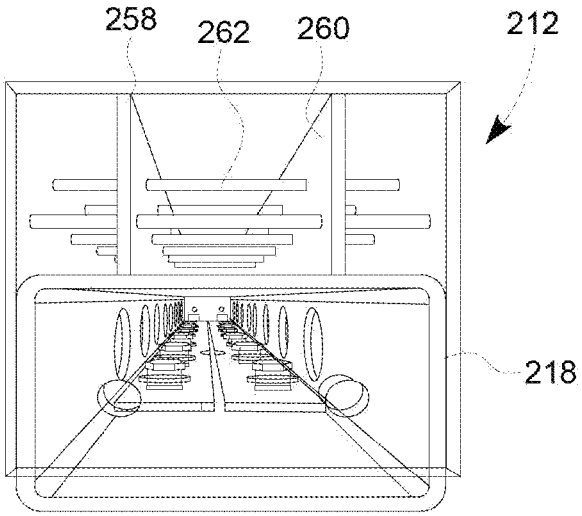
FIG. 8 is a top view of a wall end assembly in accordance with the subject disclosure.
Figure 9:
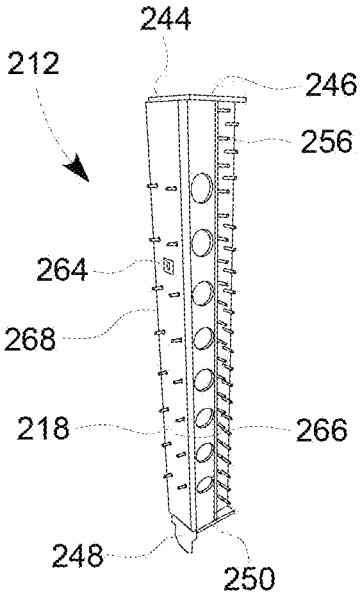
FIG. 9 is a perspective view of the wall end assembly shown in FIG. 8.

As shown in FIGS. 8-9, the wall end assembly 212 can include a pin assembly 256 that provides another mechanism to absorb energy during seismic activity or other related stresses that are applied to the core unit 200. The pin assembly 256 can include a pair of shear plates 258-260 and a plurality of pins 262. In some embodiments, the shear plates 258-260 are substantially in-plane with each other as fabricated to provide a wooden member with the ability to slide on and to receive the pins 262 correctly.

The column assembly 210 can include additional slots 264-266 along a vertical face 268 that facilitate horizontal connections within a core structure, such as one or more of the building core structures 100A-100E shown in FIGS. 1-5. Additionally, the column assembly 210 can include one or more plates 270 that positions the female fastening members 228 in a predetermined pattern.

Figure 12:
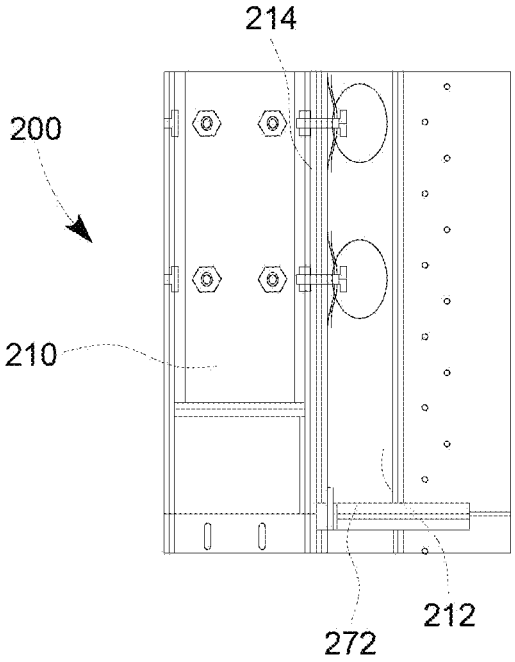
FIG. 12 is a fragmentary side view of the exemplary building core shown in FIG. 10.

Further, it should be understood that a plate 272 shown in FIG. 12 can include bolts or other similar fasteners in some embodiments. The bolts can contribute to seismic hold down.

Figure 11:
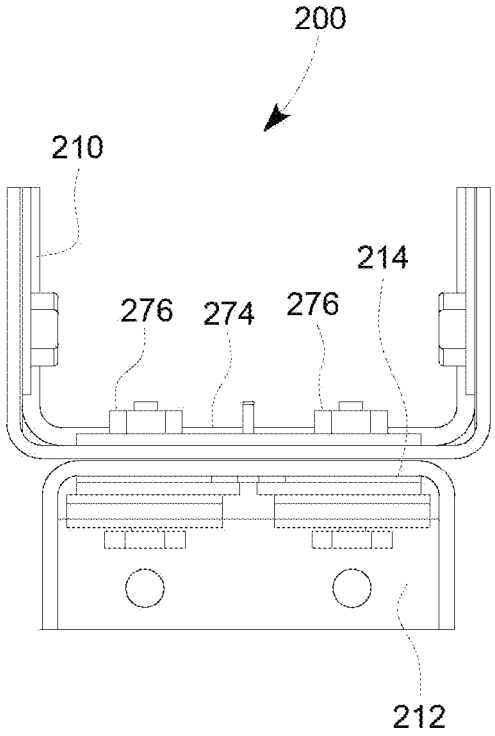
FIG. 11 is a fragmentary top view of the exemplary building core shown in FIG. 10.

Additionally, it should be understood that a plate 274 shown in FIG. 11 can hold fasteners 276. In this exemplary embodiment, the fasteners 276 are nuts.

In some embodiments, the slots 266 can be round and the slot 264 can be slotted vertically. The slots 264-266 can be used in the process of rotating the "exemplary building core as per FIG. 1 into a vertical and plumb position during setting with the crane. Specifically, the plumbing up is accomplished in three steps.

First, tab 248 inserts into the top slot 266 of a wall-end assembly member previously installed below thereof. Crane rigging (not shown) is used to move the "exemplary building core" piece into a semi-vertical position upon which a wall-end assembly drops down onto another wall-end assembly member or onto a stack of steel shims.

Second, a spud wrench is used through the round lower hole into a receiving pocket that is made to exist in a connector column. The hand movement of the spud wrench further manipulates an exemplary building core component into a more vertical position by lever action. Nothing is left in this hole or pocket following the use of the wheel bolt in the next step.

Third, a wheel bolt with conical shape between its cylindrical shaft and hexagonal head, is used in the upper vertical slot, which has tapered sides. The tightening of the wheel bolt within that slot, which has movement tolerance vertically but not horizontally, provides the final plumbing up and alignment between an exemplary building core component and a connector column.

Then, all sixteen bolts in the bolting pattern is fully aligned. Each male fastener 226 and its corresponding female fastening member 228 become concentrically aligned in congruent patterns of sixteen locations of fastening from the wall-end assembly into the connector column.

The wheel bolt is left in place, specifically, as soon as wheel bolts are in place at both ends of the exemplary building core component, crane rigging hardware can be rapidly released for the next pick and all male fasteners, which can be thirty-two male fasteners in this exemplary embodiment, can be installed without further need for the use of the crane, and in a rapid manner.

Further, it should be understood that shims should be used on site during "leveling up" operations because the height of wall-end assemblies and structural wood panels that are connected thereto can be shorter than a connector column. By leveling up each end of the building core, the bottom of each wall-end assembly (from which the bolt pattern is measured) lines up with the elevation of the bottom of each corresponding connector column (from which the congruent bolt pattern is also measured).

Figure 10:
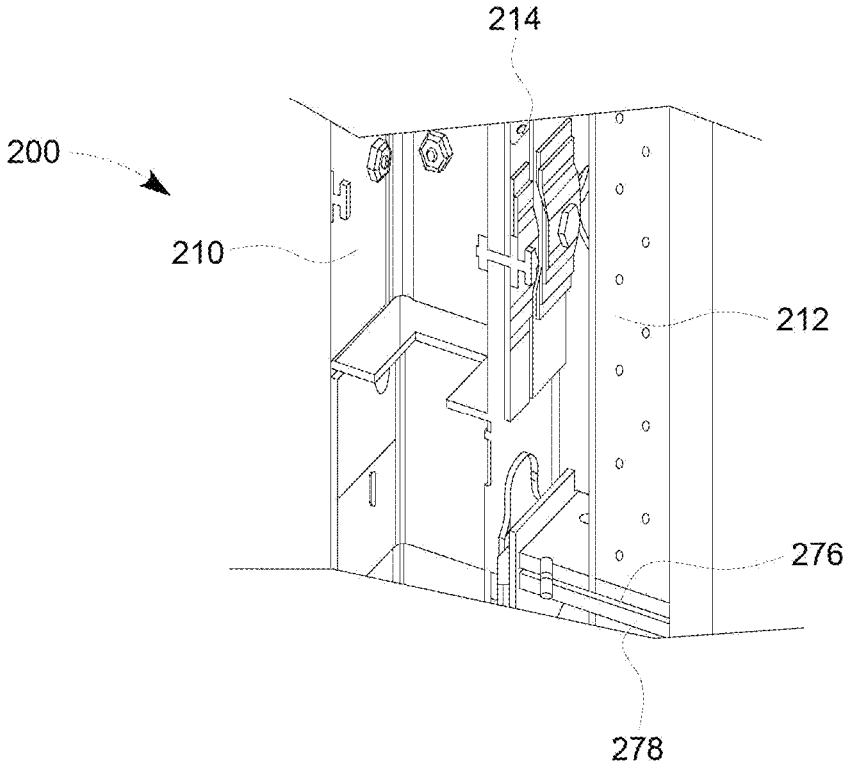
FIG. 10 is a fragmentary perspective view of an exemplary building core in accordance with the subject disclosure.
Figure 14:
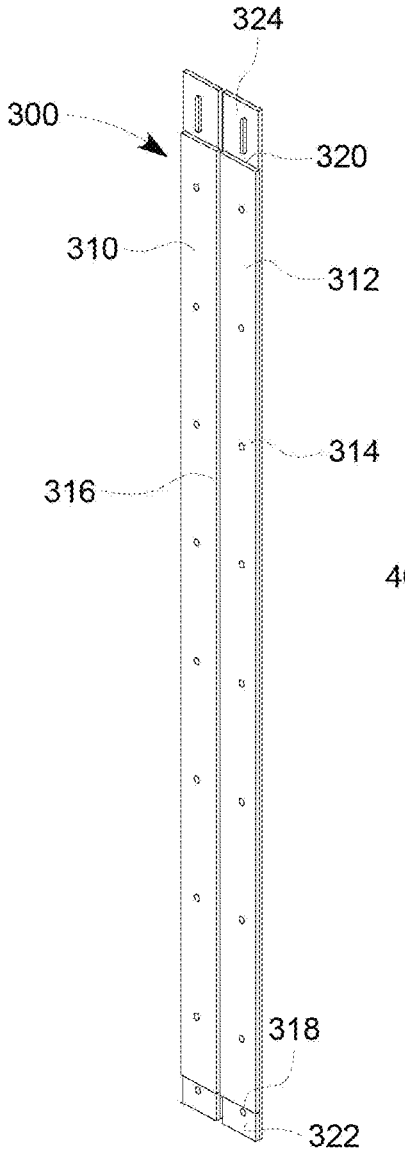
FIG. 14 is perspective view of a compressible pad holding plate in accordance with the subject disclosure.

Referring to FIG. 10, shims (not shown) in the same shape of a thick plate 276 positioned near the bottom of the wall-end assembly 212 to ensure that it can be positioned on a lower level wall-end assembly 278 in a stable manner. In order to accommodate the placement of the shims, each wall-end assembly 212 is shorter than the floor to floor height of the building Referring now to FIG. 14 with continuing reference to the foregoing figures, a compressible pad holding plate, generally designated with the numeral 300, is shown. The compressible pad holding plate 300 is an essentially flat, rectilinear plate formed from a pair of flat members 310-312 with a plurality of holes 314 therein.

When the compressible pad holding plate 300 is installed, the members 310-312 define a trough 316 therebetween. Each end 318-320 includes a flatter, slotted connecting portion 322-324 extending therefrom.

Figure 15:
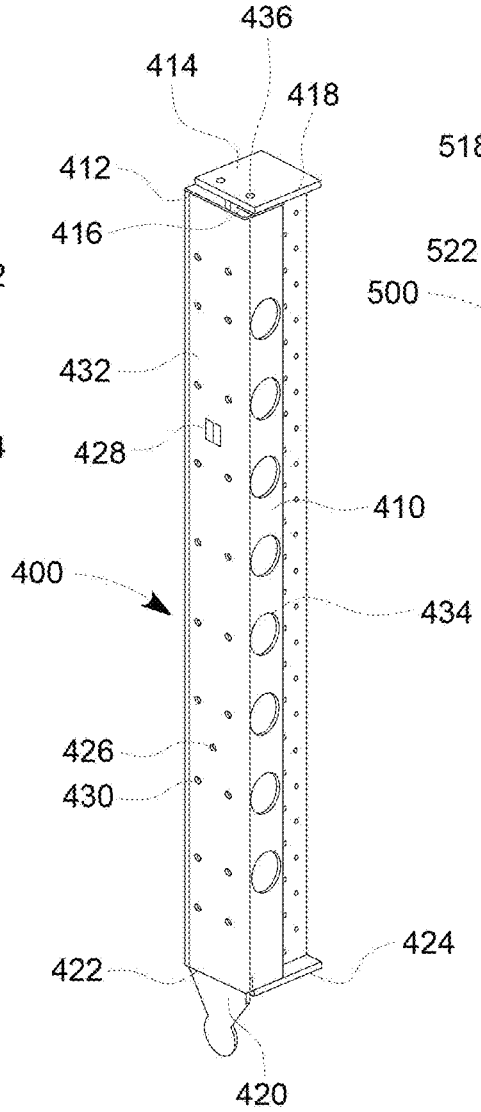
FIG. 15 is a perspective view of another embodiment of a wall end assembly in accordance with the subject disclosure.

Referring now to FIG. 15 with continuing reference to the foregoing figures, another embodiment of a wall end assembly, generally designated by the numeral 400, is shown. Like the embodiment shown in FIG. 9, the wall end assembly 400 includes an elongated member 410 with a tubular portion 412 and plate 414 defining a slot 416 at on one end 418 and a tab 420 on the opposite end 422. The wall end assembly 400 further includes a shimming surface 424. In this exemplary embodiment, the tab 420 can be tear-drop-shaped to fit into a slot (not shown) of a previously-installed wall-end assembly that is positioned below.

The elongated member 410 includes an alignment hole 426 for a spud wrench (not shown), an alignment feature 428, and a plurality of holes 430 for keeper bolts (not shown) along a surface 432. The elongated member 410 further includes a plurality of hand access holes 434.

The plate 414 can include a pair of holes 436 that can receive hold-down bolts to connect successive stories core structures to counteract the occurrence of seismic uplift forces.

The alignment feature 428 can receive a wheel bolt (not shown) from a wall assembly that can be threadedly connected thereto. The alignment feature 428 includes a slot that provides only horizontal (i.e., not vertical positioning) of a wall-end assembly centerline to force it to match to a connector column centerline.

Figure 16:
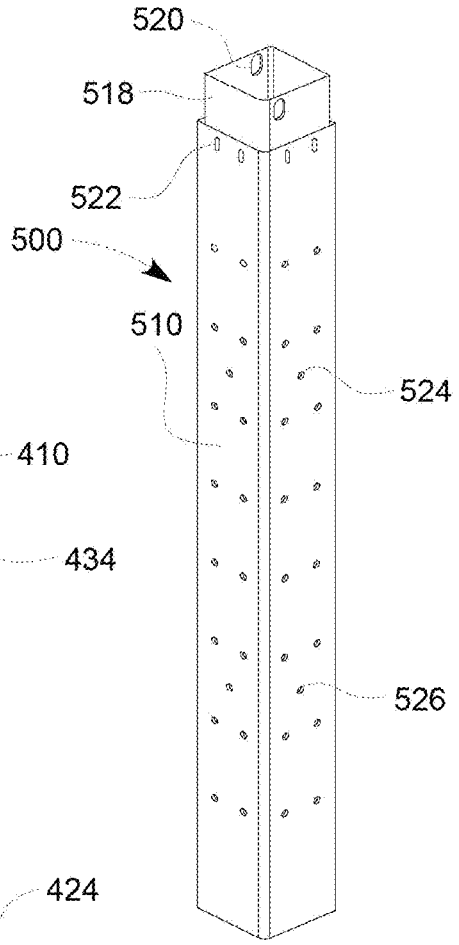
FIG. 16 is a perspective view of another embodiment of a column assembly in accordance with the subject disclosure.
Figure 17:
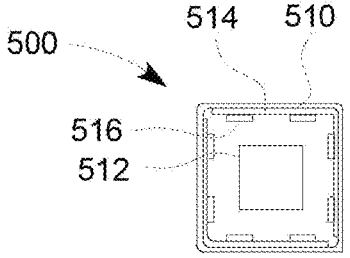
FIG. 17 is a cross sectional view of the column assembly shown in FIG. 16.

Referring now to FIGS. 16-17 with continuing reference to the foregoing figures, another embodiment of a column assembly, generally designated by the numeral 500, is shown. Like the column assembly shown in FIG. 7, the column assembly 500 includes an elongated tubular member 510.

Figure 7:
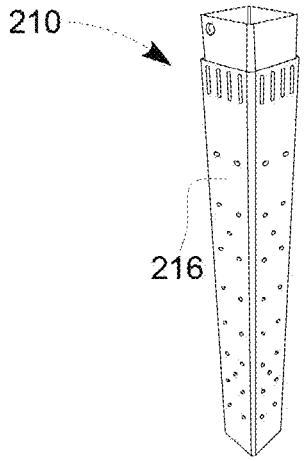
FIG. 7 is a perspective view of the column assembly shown in FIG. 6.

Unlike the embodiment shown in FIG. 7, the column assembly 500 includes a stiffener plate 512 positioned within the elongated tubular member 510 and a nut carrier plate 514. The nut carrier plate 514 includes a plurality of Nyloc nuts 516 welded thereto.

The elongated tubular member 510 further includes an end section 518 having a lifting point 520 therein. The elongated member 510 further includes a plurality of pocket weld slots 522. In this exemplary embodiment, the lifting point 520 can define that can fit a rotary lift lug, such as the rotary lift lug that is produced by Tandemloc, Inc. of Havelock, North Carolina.

In this exemplary embodiment, the nut carrier plate 514 includes holes that are formed therein in advance of placement of the nuts 516 thereon. The holes are hexagonal holes that are water-jet cut, which enables small spot welds to be placed thereon to rotationally and to positionally fix the nuts 516 relative to the nut carrier plate 514.

Additionally, the exemplary configuration reduces the amount of welds that are required and eliminates the risk of welding temperatures melting or burning the Nyloc material within the nuts 516.

The configuration further enables the nuts 516 to be kept orthogonal to the face of the nut carrier plate 516 during and after the welding process. The welding process/welds can produce distortions due to introduction of differential weld cooling tensile stresses.

The elongated tubular member 510 can include a plug weld (not shown) in fabrication to hold the midsection of the internal nut carrier plate 514.

The column assembly 500 can include an internally threaded hole 524 for receiving wheel bolt and a blind hole 526 that can receive a tip of a spud wrench. These holes 524-526 can be used in the assembly of a vertical wall segment.

Figure 18:
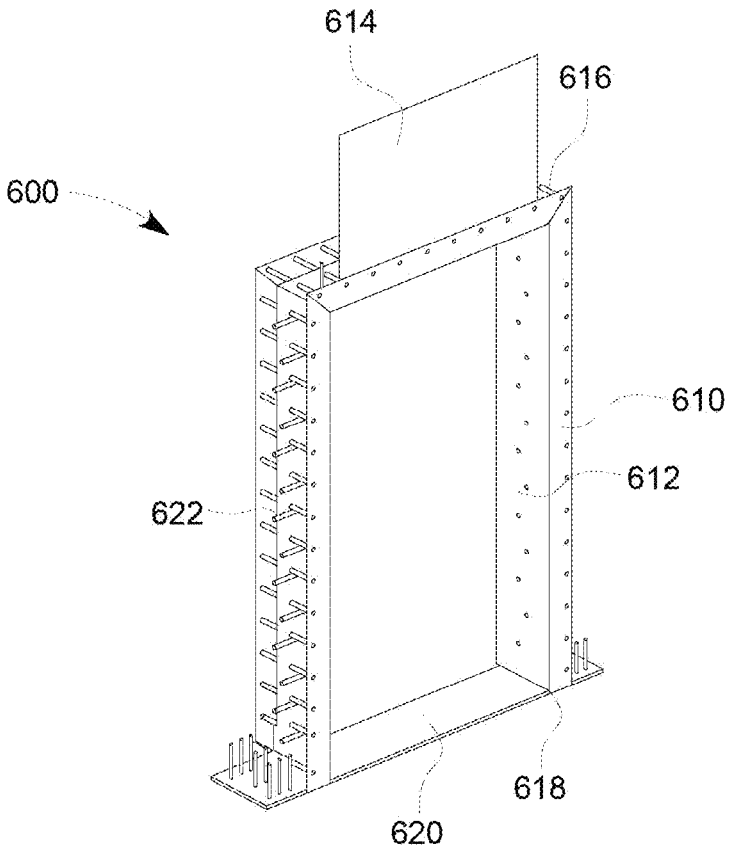
FIG. 18 is a perspective view of a door frame assembly in accordance with the subject disclosure.

Referring now to FIG. 18 with continuing reference to the foregoing figures, a door frame assembly, generally designated by the numeral 600, is shown. The door frame assembly 600 includes a frame 610 defining an opening 612 for receiving a door (not shown).

The frame 610 includes a shear transmission plate 614 extending from the top 616 and a door frame base plate or shear transmission strut 618 at the base 620. A plurality of screws 622 extend from the exterior of the frame 610. The shear transmission plate 614 can be welded to the edge of a door frame base plate (not shown) positioned below.

Figure 19:
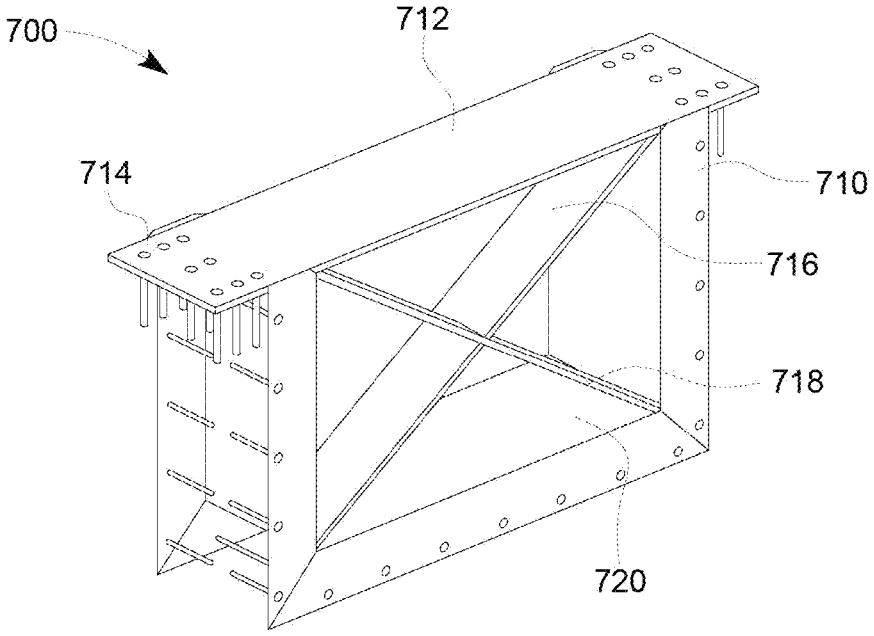
FIG. 19 is a perspective view of another embodiment of a frame assembly in accordance with the subject disclosure.

Referring now to FIG. 19 with continuing reference to the foregoing figures, another embodiment of a mechanical opening frame assembly, generally designated by the numeral 700, is shown. The frame assembly 700 can function as a mechanical vent frame.

Like the embodiment shown in FIG. 18, the mechanical opening frame assembly 700 includes a frame 710 and a base 712 having a shear transmission strut 714. Unlike the embodiment shown in FIG. 18, the mechanical opening frame assembly 700 includes a pair of cross bracing plates 716-718. The cross bracing plates 716-718 are positioned within an opening 720 defined by the frame 710. The opening 720 is internally cross-braced with intersecting plates while allowing air to flow without restriction from such bracing.

The door frame assembly 600 shown in FIG. 18 and the mechanical opening frame assembly shown in FIG. 19 can be respectively implemented as doorway opening frames and/or mechanical duct opening frames to enable shear force in panels that have openings (not shown) to be transmitted across such openings.

Figure 20:
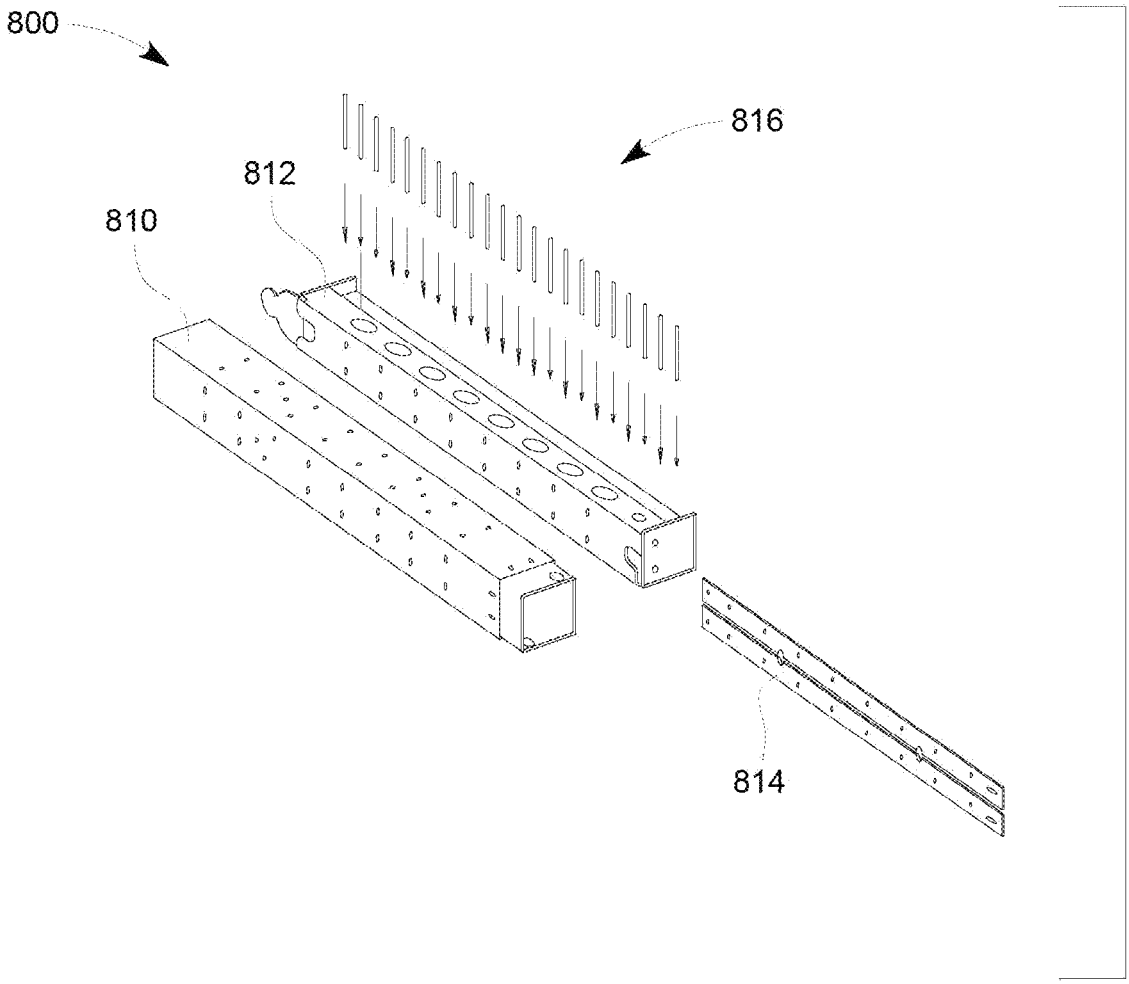
FIG. 20 is an exploded perspective view of a central core assembly in accordance with the subject disclosure.

Referring to FIG. 20 with continuing reference to the foregoing figures, a core assembly, generally designated with the numeral 800, is shown. The core assembly 800 includes a connector column 810, a wall-end assembly 812, plates 814, and pins 816. The pins 816 can be used laterally through mass timber material (not shown) to connect the material to the wall-end assembly 812.

The plates 814, which hold by adhesion, provide structural acoustical breaks and, in some embodiments, can include viscoelastic material Exemplary viscoelastic material includes Xylofon 80-shore strip material by Rothoblaas SrL of Italy.

It should be understood that various fasteners, such as bolts, Belleville (disc spring) washers, and leaf springs can be used in various embodiments.

It should also be understood that the kit of parts of the building core may also provide stairway and landing support ledger angles, elevator divider beams and related support pockets.

Supported Features and Embodiments

The detailed description provided above in connection with the appended drawings explicitly describes and supports various features of a building core and kit for assembling the building core. By way of illustration and not limitation, supported embodiments include a building core comprising: a column assembly having an elongated tubular member, a wall end assembly having an elongated tubular member, and a flexible interface connecting the column assembly to the wall end assembly, wherein the flexible interface includes a spring pack assembly having a disc spring, an elongated male fastening member, a female fastening member, and an absorbing layer, and wherein the male fastening member extends through the spring pack hole into the female fastening member to connect the column assembly to the wall end assembly with the female fastening member and to hold the male fastening member in place.

Supported embodiments include the foregoing building core, further comprising a plurality of drag strap connectors extending perpendicularly in a horizontal plane from the column assembly elongated tubular member.

Supported embodiments include any of the foregoing building cores, wherein one of the column assembly elongated tubular member and the wall end assembly elongated tubular member includes a slot on one end and a tab on the opposite end, and wherein the tab inserts into at least one of a slot in another substantially identical elongated tubular member and a slot in a base for supporting the building core.

Supported embodiments include any of the foregoing building cores, wherein the column assembly includes a first chassis and the wall end assembly includes a second chassis.

Supported embodiments include any of the foregoing building cores, wherein the elongated male fastening member is a bolt and the female fastening member is a nut.

Supported embodiments include any of the foregoing building cores, wherein the flexible interface includes a bolt carrier plate.

Supported embodiments include any of the foregoing building cores, wherein the disc spring is one of a plurality of disc springs that forms a stack.

Supported embodiments include any of the foregoing building cores, wherein the absorbing layer includes acoustical absorbing materials.

Supported embodiments include any of the foregoing building cores, wherein the absorbing layer includes acoustical pad materials.

Supported embodiments include any of the foregoing building cores, wherein the absorbing layer includes a plate abutting the acoustical absorbing materials.

Supported embodiments include any of the foregoing building cores, wherein the absorbing layer plate includes only a steel load-spreading plate and no acoustical absorbing materials.

Supported embodiments include any of the foregoing building cores, further comprising a wooden panel or engineered mass timber panel.

Supported embodiments include any of the foregoing building cores, wherein the wall end assembly includes a pin assembly to connect the wall end assembly to the panel.

Supported embodiments include any of the foregoing building cores, wherein the pin assembly includes a pair of shear plates and a plurality of pins.

Supported embodiments include any of the foregoing building cores, wherein the spring pack assembly disc spring is a first disc spring, wherein the spring pack assembly includes a second disc spring, and wherein the first disc spring and the second disc spring forms a pair of disc springs.

Supported embodiments include any of the foregoing building cores, wherein the pair of disc springs forms a first pair of disc springs, and wherein the spring pack assembly includes a second pair of disc springs.

Supported embodiments include a kit for assembling a building core comprising: a column assembly having an elongated tubular member, a wall end assembly having an elongated tubular member, and a flexible interface for connecting the column assembly to the wall end assembly, wherein the flexible interface includes a spring pack assembly having a disc spring, an elongated male fastening member, a female fastening member, and an absorbing layer, and wherein the male fastening member can extend through the spring pack hole into the female fastening member to connect the column assembly to the wall end assembly with the female fastening member and to hold the male fastening member in place when the building core is assembled.

Supported embodiments include the foregoing kit, further comprising a plurality of drag strap connectors extending perpendicularly in a horizontal plane from the column assembly elongated tubular member.

Supported embodiments include any of the foregoing kits, wherein one of the column assembly elongated tubular member and the wall end assembly elongated tubular member includes a slot on one end and a tab on the opposite end, and wherein the tab inserts into at least one of a slot in another substantially identical elongated tubular member and a slot in a base for supporting the building core.

Supported embodiments include any of the foregoing kits, wherein the column assembly includes a first chassis and the wall end assembly includes a second chassis.

Supported embodiments include an apparatus, a system, a method and/or means for implementing any of the foregoing building cores, kits, or portions thereof.

Supported embodiments can provide various attendant and/or technical advantages in terms of significant reductions in embodied carbon emissions compared to conventional building core structures Supported embodiments include building cores and kits that provide for an increased pace of project completion due to the concurrent and much faster timeline of core construction compared to traditional concrete cores. Indeed, in some instances, a conventional project that can take five days can be completed in one day using the subject building cores and kits.

Supported embodiments include building cores and kits that provide for reductions in time-dependent emissions for a project, including reductions in employee transportation, the need for temporary site facilities, and the need for temporary heating and lighting of the building due to the compressed construction timeline.

Supported embodiments include building cores and kits that provide overall cost savings for clients as a result of lower labor costs and increased timeline efficiency.

Supported embodiments includes building cores that accelerate the availability and affordability of low-carbon buildings construction solutions that can produce a broad market transformation of the building industry. The resulting buildings include lower embodied carbon than braced steel core systems. Such buildings can be assembled through an expedited erection process, as compared to concrete core systems.

Supported embodiments include building sector innovation in building designs, as well as construction practices and technologies. Such embodiments further provide for increased industry capacity and for systems that foster public awareness of sustainable construction practices.

Supported embodiments include core structures and/or kits that substitute concrete or steel bracing and have the ability to form the elevator shafts and staircase supporting structures.

Supported embodiments include core structures and/or kits that provide for buildings that are seismically resilient, while maintaining occupant comfort as the core structures sway. In some embodiments, the buildings can include fire rating drywall board that encapsulates the structures.

Supported embodiments include structures that include lower embodied carbon than braced steel core system that can be erected in an expedited manner relative to concrete core systems.

Supported embodiments include core systems that utilize mass timber to reduce the embodied carbon footprint associated with the building core.

The detailed description provided above in connection with the appended drawings is intended as a description of examples and is not intended to represent the only forms in which the present examples can be constructed or utilized.

It is to be understood that the configurations and/or approaches described herein are exemplary in nature, and that the described embodiments, implementations and/or examples are not to be considered in a limiting sense, because numerous variations are possible. For example, It should be understood that various fasteners, such as bolts, Belleville (disc spring) washers, and leaf springs can be used in various embodiments in addition to stairway and landing support ledger angles, elevator divider beams and related support pockets.

The specific processes or methods described herein can represent one or more of any number of processing strategies. As such, various operations illustrated and/or described can be performed in the sequence illustrated and/or described, in other sequences, in parallel, or omitted. Likewise, the order of the above-described processes can be changed.

Although the subject matter has been described in language specific to structural features and/or methodological acts, it is to be understood that the subject matter defined in the appended claims is not necessarily limited to the specific features or acts described above. Rather, the specific features and acts described above are presented as example forms of implementing the claims.

What is claimed is:

1. A building core comprising:

a column assembly having an elongated tubular steel member, a wall end assembly having an elongated tubular steel member, and a flexible interface connecting the column assembly to the wall end assembly, wherein the flexible interface includes a spring pack assembly having a disc spring, an elongated male fastening member, a female fastening member, a spring pack having a hole extending therethrough and an absorbing layer, wherein the disc spring is positioned between the spring pack and the absorbing layer, and wherein the male fastening member extends through the spring pack hole into the female fastening member to connect the column assembly to the wall end assembly with the female fastening member and to hold the male fastening member in place.

2. The building core of claim 1, further comprising a plurality of drag strap connectors extending perpendicularly in a horizontal plane from the column assembly elongated tubular member.

3. The building core of claim 1, wherein one of the column assembly elongated tubular member and the wall end assembly elongated tubular member includes a slot on one end and a tab on the opposite end, and wherein the tab inserts into at least one of a slot in another substantially identical elongated tubular member and a slot in a base for supporting the building core.

4. The building core of claim 1, wherein the column assembly includes a first chassis and the wall end assembly includes a second chassis.

5. The building core of claim 1, wherein the elongated male fastening member is a bolt and the female fastening member is a nut.

6. The building core of claim 1, wherein the flexible interface includes a bolt carrier plate.

7. The building core of claim 1, wherein the disc spring is one of a plurality of disc springs that forms a stack.

8. The building core of claim 1, wherein the absorbing layer includes acoustical pad materials.

9. The building core of claim 1, wherein the absorbing layer includes acoustical absorbing materials.

10. The building core of claim 9, wherein the absorbing layer includes a plate abutting the acoustical absorbing materials.

11. The building core of claim 9, wherein the absorbing layer plate includes a steel load-spreading plate.

12. The building core of claim 1, wherein the spring pack assembly disc spring is a first disc spring, wherein the spring pack assembly includes a second disc spring, and wherein the first disc spring and the second disc spring forms a pair of disc springs.

13. The building core of claim 12, wherein the pair of disc springs forms a first pair of disc springs, and wherein the spring pack assembly includes a second pair of disc springs.

14. The building core of claim 1, further comprising a panel.

15. The building core of claim 14, wherein the wall end assembly includes a pin assembly to connect the wall end assembly to the panel.

16. The building core of claim 15, wherein the pin assembly includes a pair of shear plates and a plurality of pins.

17. A kit for assembling the building core of claim 1 comprising:

a column assembly having an elongated tubular steel member, a wall end assembly having an elongated tubular steel member, and a flexible interface configured to connect the column assembly to the wall end assembly, wherein the flexible interface includes a spring pack assembly having a disc spring, an elongated male fastening member, a female fastening member, a spring pack having a hole extending therethrough and an absorbing layer, wherein the disc spring is configured to be positioned between the spring pack and the absorbing layer, and wherein the male fastening member is configured to extend through the spring pack hole into the female fastening member to connect the column assembly to the wall end assembly with the female fastening member and to hold the male fastening member in place in the building core's assembled configuration.

18. The kit of claim 17, further comprising a plurality of drag strap connectors extending perpendicularly in a horizontal plane from the column assembly elongated tubular member.

19. The kit of claim 17, wherein one of the column assembly elongated tubular member and the wall end assembly elongated tubular member includes a slot on one end and a tab on the opposite end, and wherein the tab inserts into at least one of a slot in another substantially identical elongated tubular member and a slot in a base for supporting the building core.

20. The kit of claim 17, wherein the column assembly includes a first chassis and the wall end assembly includes a second chassis.

* * * * *